US007690274B2

(12) United States Patent
Telimaa et al.

(10) Patent No.: US 7,690,274 B2
(45) Date of Patent: Apr. 6, 2010

(54) PIPETTE WITH A TIP REMOVING MECHANISM

(75) Inventors: Juha Telimaa, Järvenpää (FI); Vesa Salo, Rajamaki (FI); Mikael Lind, Helsinki (FI)

(73) Assignee: Thermo Fisher Scientific Oy, Vantaa (FI)

( * ) Notice: Subject to any disclaimer, the term of this patent is extended or adjusted under 35 U.S.C. 154(b) by 658 days.

(21) Appl. No.: 10/579,875

(22) PCT Filed: Nov. 18, 2004

(86) PCT No.: PCT/FI2004/000694

§ 371 (c)(1),
(2), (4) Date: Apr. 13, 2007

(87) PCT Pub. No.: WO2005/049209

PCT Pub. Date: Jun. 2, 2005

(65) Prior Publication Data

US 2007/0272037 A1 Nov. 29, 2007

(30) Foreign Application Priority Data

Nov. 19, 2003 (FI) ..... 20031683

(51) Int. Cl.
*B01L 3/02* (2006.01)

(52) U.S. Cl. ..... 73/864.01; 73/864.11; 73/864.13; 73/864.16

(58) Field of Classification Search . 73/864.13–864.18, 73/864.01, 864.11
See application file for complete search history.

(56) References Cited

U.S. PATENT DOCUMENTS

| | | | | |
|---|---|---|---|---|
| 1,511,566 | A | 10/1924 | Kollock | |
| 3,315,643 | A | 4/1967 | Eratico | |
| 3,882,729 | A * | 5/1975 | Roach | 73/864.18 |
| 4,261,205 | A | 4/1981 | Oshikubo et al. | |
| 4,399,712 | A | 8/1983 | Oshikubo et al. | |
| 5,507,193 | A | 4/1996 | Ishihara | |
| 6,833,114 | B1 * | 12/2004 | Christen et al. | 73/864.14 |
| 6,923,938 | B2 * | 8/2005 | Cote et al. | 73/864.11 |

FOREIGN PATENT DOCUMENTS

| | | |
|---|---|---|
| EP | 0 566 939 A1 | 10/1993 |
| GB | 1 269 580 | 4/1972 |

OTHER PUBLICATIONS

Finnish Search Report.
International Search Report.

* cited by examiner

*Primary Examiner*—Hezron Williams
*Assistant Examiner*—Nashmiya S Fayyaz
(74) *Attorney, Agent, or Firm*—Nixon & Vanderhye P.C.

(57) ABSTRACT

The invention relates to a pipette, comprising a tip remover element which, upon moving it against a tip, disengages the tip. The remover element is operated with a mechanism, comprising a rotatable ramp member which is provided with a circle-forming ramp surface, including one or more segments within which the ramp surface has a high point and a low point, whereby the ramp surface, upon rotating through a single segment, forces the remover element first to move against the tip and then allows it to return.

4 Claims, 2 Drawing Sheets

PIPETTE WITH A TIP REMOVING MECHANISM

This application is the US national phase of international application PCT/FI2004/000694 filed 18 Nov. 2004 which designated the U.S. and claims benefit of FI 20031683, dated 19 Nov. 2003, the entire content of which is hereby incorporated by reference.

TECHNICAL FIELD

The invention relates to a plunger-operated pipette for use in dispensing liquids and provided with a tip remover. The invention relates explicitly to this tip remover.

BACKGROUND ART

In plunger-operated pipettes, the tip element is usually provided with a replaceable tip container or a tip used for drawing therein a liquid to be subsequently dispensed. Usually, pipettes also include a tip remover, comprising a collar slidable along the tip element, and a spring against whose force the collar is pressable downwards. Electrically operated pipettes have also been available, in which the plunger is operated by means of an electric motor. Even in such pipettes, the tip remover has usually been manually operated.

Publication U.S. Pat. No. 4,399,712 discloses an electrically operated pipette, in which the tip remover is powered by the same motor as the plunger. In that configuration, the plunger is provided with two nuts, which are non-rotatable relative to the housing and fitted on motor-driven lead screws. When it is time to remove the tip, the plunger is driven to its bottom position, the nuts pressing a spring-loaded tip removing collar downwards. When the tip is removed, the motor is driven respectively in reverse.

SUMMARY OF THE INVENTION

According to the invention, the tip removing mechanism comprises a rotatable ramp member, having a circle-forming ramp surface with one or more segments, each of said segments having a top position and a bottom position on the ramp surface. In a basic condition, the remover element is in the top position. In response to its rotation, the ramp member forces the remover element towards the tip. A segment is followed by stopping the ramp member at the commencement of a next segment and a new tip can be attached to the pipette. The mechanism can be provided with a spring for returning the remover element. The ramp member can be rotated by means of a motor, such as an electric motor. Stopping of the motor after a segment is most preferably performed automatically.

According to the invention, a removal function of the tip can be effected by means of a one-way rotating action. This enables a simpler control. Neither does the return require motorized power. The function will also be more reliable in operation, since the mechanism does not become jammed as easily as in the case that the mechanism is driven by a motor in two directions.

The ramp member can be located particularly above the top end of a remover element. The ramp surface can be against a similar surface in contact with the remover element.

The ramp member can be rotated especially about an axis parallel to the moving direction of the remover element. However, the axis can be for example perpendicular or inclined relative to the moving direction.

The ramp surface may have for example one segment per circle. Between the bottom and top positions can be provided a substantially vertical section. The segment profile between the top position and the bottom position can be for example flat or wave shaped. There may also be several segments per circle, usually identical segments. The segment may also have a length en excess of a circle.

The removing mechanism control includes preferably a feature to turn off the motor automatically once the remover has returned to its top position. This can be implemented for example by means of an angular sensor capable of identifying a rotational position of the ramp member. It is optional to use a linear sensor capable of identifying a position of the plunger.

DRAWINGS

The attached drawings constitute a part of the written description of the invention and relate to the subsequent detailed specification dealing with a few embodiments of the invention. Therein FIG. 1 shows a pipette, wherein a plunger is operated manually FIG. 1*a* shows in an exploded axonometric view a portion of the tip removing mechanism for the pipette of FIG. 1

DETAILED DESCRIPTION OF SOME EMBODIMENTS OF THE INVENTION

Figure 1:
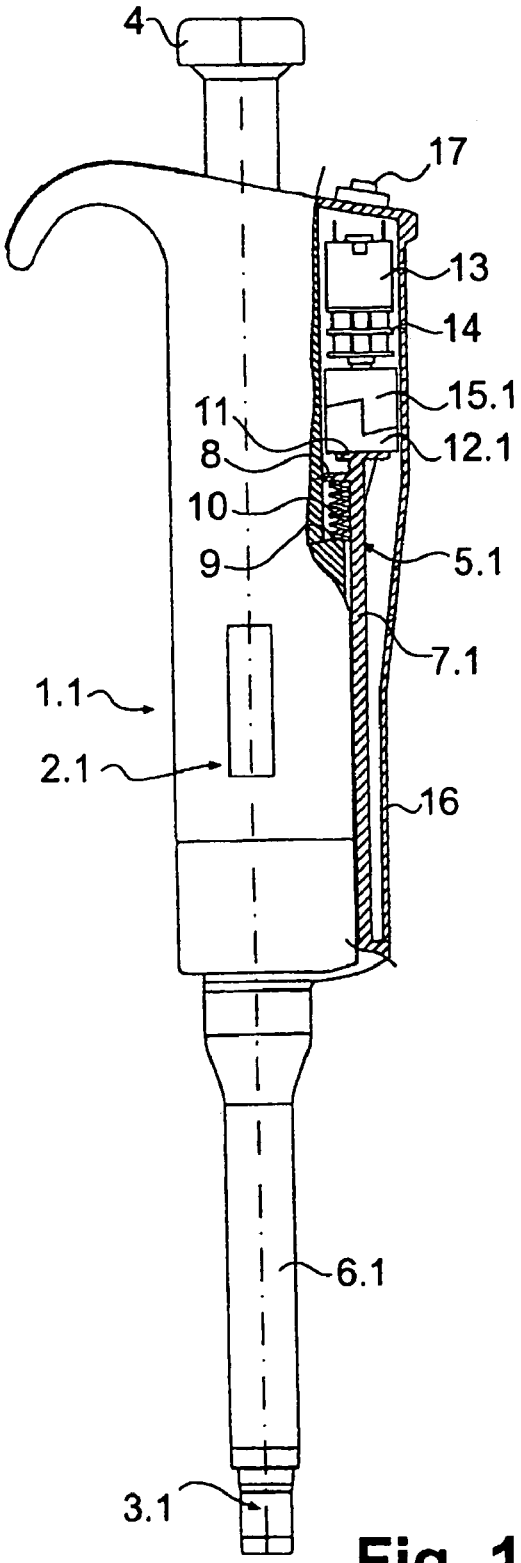
Figure 2:
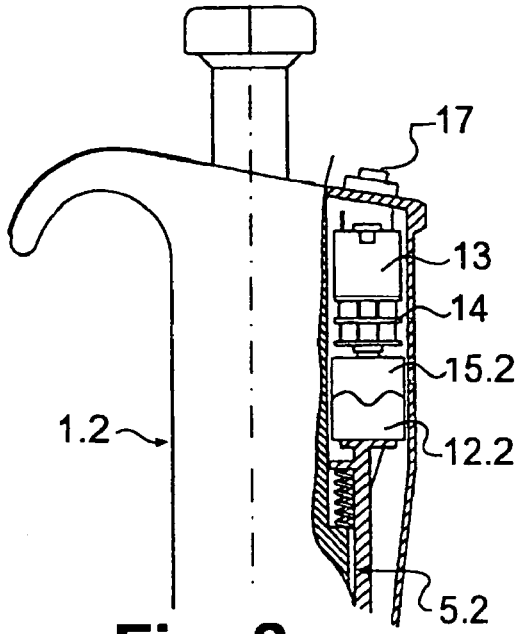
FIG. 2 shows another pipette, wherein a plunger is operated manually
Figure 1A:
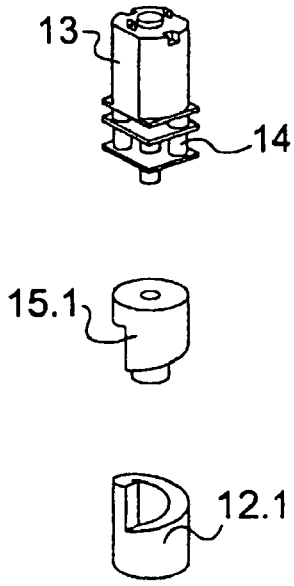
Figure 3:
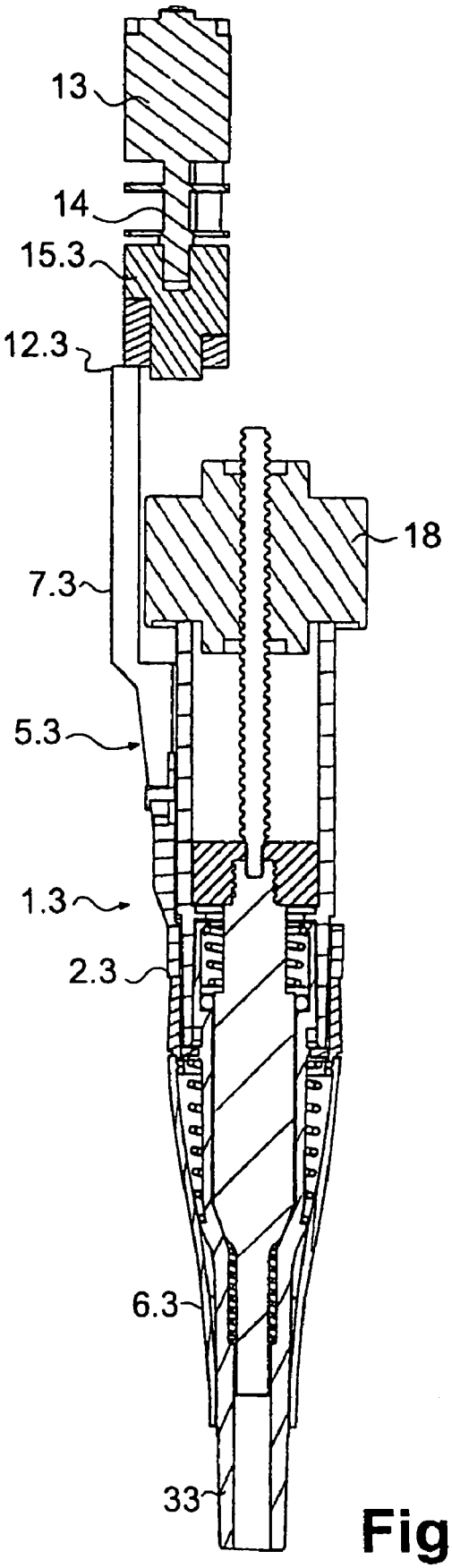
FIG. 3 shows portions of a pipette, wherein a plunger is operated by a motor.

Some pipettes of the invention will now be further described in more detail.

A pipette 1.1 comprises a housing 2.1 and a tip element 3.1 at its bottom end, a tip container or a tip being attached to said bottom end for a liquid. The housing has its top end provided with an actuating button 4 for operating the pipette's plunger. The design can be, for example, similar to what is disclosed in publication FI 64752 (corresponds to publication EP 112887).

The pipette 1.1 is provided with a tip removing mechanism 5.1. It comprises a tip removing collar 6.1 slidable along the tip element 3.1. Secured to its top end is an operating rod 7.1 slidable alongside the housing 2.1. Near the operating rod's top end is an inward extension 8 and the housing has therebelow an outward support 9. Interposed between the extension and the support is a return spring 10, pressing the operating rod to its top position. The operating rod's top end is provided with a crosswise bracket 11. The bracket is fitted with a ramp abutment 12.1. Its top surface comprises a response surface, extending spirally around the surface for a single circle and descending clockwise as viewed from above. At the commencement (and thus, likewise, at the completion) of a circle there is a vertical step. The housing has its upper section above the rod fitted with an electric motor 13 (e.g. a DC motor), its drive shaft extending downwards. By way of a gear system 14 the drive shaft is provided with a ramp member 15.1, which is rotatable on top of the ramp abutment and has its bottom surface comprising a ramp surface complementary to and fitting against the response surface of the ramp abutment.

In the process of rotating the ramp member 15.1 counterclockwise as viewed from above, the ramp surface forces the ramp abutment 12.1, and therealong the operating rod 7.1 and the tip removing collar 6.1, to move downwards. The ramp member and the ramp abutment are dimensioned in such a way that the tip removing collar effects a movement sufficient to disengage a tip attached to the pipette's tip element. After one circle, the ramp surface and the response surface have their vertical points again in register with each other, whereby the ramp abutment, the operating rod, and the tip removing collar return to their top position in response to the return spring 10. Thus, the tip removing operation only requires the motor 13 to be driven in one direction.

Alongside the housing there is a cover 16 for concealing components of the tip removing mechanism present alongside the housing. By means of the cover, the pipette has the upper part of its hand-gripping portion designed to be wider, the pipette providing a good fit for the hand. Provided thereby is also space in lateral direction for the motor 13, the gear system 14, the ramp member 15.1 and the ramp abutment 12.1. The axis for these is located further out relative to the operating rod and the bracket 11 is also wider outward than inward in lateral direction.

The cover 16 has its top surface provided with an operating switch 17 for the tip removing mechanism.

A pipette 1.2 is otherwise similar to the pipette 1.1 except that a tip removing mechanism 5.2, a ramp abutment 12.2, and a ramp member 15.2 are provided with a peripheral wave shaped surface. This includes four waves, whereby the removal of a tip only requires one quarter of a circle. In order to return the mechanism to a top position, the ramp member must be rotated further (or allowed to rotate) from its removing position.

A pipette 1.3 comprises a housing 2.3 with a tip element 3.3 at its bottom end. The plunger is operated by means of an electric motor 18 and a lead screw. The design can be similar to what is disclosed for example in publication EP 576967.

The pipette 1.3 is provided with a tip removing mechanism 5.3. It comprises a tip removing collar 6.3 slidable along a tip element 3.3. To its top end is mounted an operating rod 7.3 slidable alongside the housing 2.3. Above the rod there is mounted an electric motor 13 (e.g. a DC motor), having its shaft provided, by way of a gear system 14, with a ramp member 15.3 rotatable on top of the rod's upper end.

The ramp member 15.3 has its bottom end provided with an encircling ramp surface lying against a top end 12.3 of the operating rod 7.3. The ramp surface lies at different levels in various parts of a circle. When the operating rod, and hence also the tip removing collar 6.3, is in a top position, the ramp surface has its highest point against the rod's top end. When it is time to remove the tip, the motor 13 is started to commence rotation of the ramp member and sliding of the ramp surface on the rod's top end surface with the result that the ramp surface will have its lowest point in alignment with the rod's top end. This results in the ramp surface forcing the operating rod, and hence also the tip removing collar, downwards. The ramp surface consists of one segment, wherein the surface level descends from a high point to a low point and then returns as a return section up to the highest point.

The invention claimed is:

1. A pipette comprising:

a housing defining a pipette axis;

a tip removably fitted onto a distal end of the housing for receiving a liquid therein; and a tip removal mechanism for removing the tip from the housing, wherein the tip removal mechanism comprises, (i) an operating rod which is reciprocally movable relative to the housing axis between retracted and extended positions;

(ii) a ramp member which is rotatable about a rotation axis that is parallel to the pipette axis;

(iii) a ramp abutment member fixed to an upper end of the operating rod and defining a response surface in opposition to and in contact with the ramp surface; wherein (iv) each of the ramp and response surfaces define an opposed circular spiral surface having a high point, a low point and a substantially vertical step between the high and low points such that rotation of the ramp member causes the ramp surface to rotatably move against the response surface to thereby responsively displace the operating rod from the retracted position to the extended position thereof and thereby remove the tip from the housing.

2. A pipette as in claim 1, further comprising a motor connected to the ramp member and operable to rotate the ramp member about the rotation axis.

3. A pipette as in claim 1, wherein the tip removal mechanism further comprises a spring member operable to assist the operating rod to return to the retracted position from the extended position thereof.

4. A pipette as in claim 1, wherein the operating rod comprises a tip removal collar which is slidable along the housing.

* * * * *